US006084606A

United States Patent [19]

Moriyama

[11] Patent Number: 6,084,606

[45] Date of Patent: Jul. 4, 2000

[54] PRINTING APPARATUS AND CHECK PATTERN PRINTING METHOD

[75] Inventor: Jiro Moriyama, Kawasaki, Japan

[73] Assignee: Canon Kabushiki Kaisha, Tokyo, Japan

[21] Appl. No.: 09/046,547

[22] Filed: Mar. 24, 1998

[30] Foreign Application Priority Data

Mar. 28, 1997 [JP] Japan ..... 9-077633

[51] Int. Cl.[7] ..... B41J 29/393

[52] U.S. Cl. ..... 347/19

[58] Field of Search ..... 347/19, 5, 12, 347/13, 37, 40

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 5,241,325 | 8/1993 | Nguyen | 346/1.1 |
| 5,250,956 | 10/1993 | Haselby et al. | 346/1.1 |
| 5,289,208 | 2/1994 | Haselby | 346/140 R |
| 5,297,017 | 3/1994 | Haselby et al. | 346/1.1 |
| 5,534,895 | 7/1996 | Lindenfelser et al. | 347/19 |
| 5,644,344 | 7/1997 | Haselby | 347/19 |

FOREIGN PATENT DOCUMENTS

| | | |
|---|---|---|
| 0 540 245 | 5/1993 | European Pat. Off. . |
| 0 589 718 | 3/1994 | European Pat. Off. . |
| 0 622 220 | 11/1994 | European Pat. Off. . |
| 0 622 238 | 11/1994 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—Richard Moses

*Attorney, Agent, or Firm*—Fitzpatrick, Cella, Harper & Scinto

[57] ABSTRACT

A check pattern for a registration adjustment under a low resolution condition of 600 dpi×600 dpi at a substantially central portion of a printing medium is printed. After performing the registration adjustment based on the printed pattern, the check pattern is printed under a high resolution condition of 1200 dpi×600 dpi at a position not causing interference with the former check pattern. On a basis of this, the registration adjustment is again performed. By this, the registration adjustment in high precision printing can be performed easily. Also, two check patterns can be printed on a single printing medium to permit lowering of cost concerning the printing medium to be used in check pattern printing.

19 Claims, 6 Drawing Sheets

PRINTING APPARATUS AND CHECK PATTERN PRINTING METHOD

This application is based on patent application Ser. No. 077,633/1997 filed Mar. 28, 1997 in Japan, the content of which is incorporated hereinto by reference.

BACKGROUND OF THE INVENTION

1. Field of the Invention

The present invention relates generally to a printing apparatus and a check pattern printing method. More specifically, the invention relates to a printing apparatus which can print a check pattern used for performing registration adjustment between a plurality of printing heads and for judging whether printing is performed normally, and to a printing method of printing the check pattern.

2. Description of the Related Art

An ink-jet printing apparatus as a typical printing apparatus, particularly a bubble-jet type printing apparatus has an advantage of arranging ink ejection openings of a printing head in high density and whereby of being capable of performing high precision printing. On the other hand, it is one of trends for a recent printing apparatus to require printing an image of high precision and high image quality.

Incidentally, in the apparatus employing a plurality of printing heads, such as an apparatus performing a full-color printing, it has been known to perform a registration adjustment so that respective dots formed by inks ejected from the printing heads can maintain predetermined positional relationship, for example, positional relationship in which dots formed by inks ejected from these printing heads are overlappingly formed at substantially the same position on a printing medium. One prior art for the registration adjustment is to perform printing a predetermined check pattern on the printing medium by respective heads and to adjust ejection timing of respective head on a basis of deviation amount of respective patterns with respect to each other.

Further, it has been performed that when inspection is performed for each ejection opening whether ink ejection is performed normally or not, by actually performing ink ejection to the printing medium, in similar manner, and by visually checking the results of printing.

However, in the apparatus performing high precision printing, when the foregoing conventional registration adjustment or checking on normal printing is to be performed, it may occur that the adjustment or the check may be insufficient.

More specifically, for performing high precision printing, the registration adjustment per se has to be performed in high resolution. For example, when the high precision printing of 1200 dpi compared to a normal printing of 400 dpi is performed in scanning direction of the printing head, the registration adjustment at three-times higher precision with respect to the registration adjustment for the normal printing is required. Therefore, a longer time is required for the registration adjustment depending upon increasing of the resolution.

On the other hand, the check pattern to be printed on the printing medium for adjustment of registration or checking of the normal printing is preferred to have no bleeding or the like for performing checking in high precision. Therefore, for example, with respect to the printing medium used for performing printing of the check pattern, it is required to use a relatively expensive printing medium which is difficult to cause bleeding. In this case, for example, when only a single check pattern is printed on one printing medium, a correspondingly increased number of printing medium has to be wasted to cause a relatively high running cost.

SUMMARY OF THE INVENTION

It is an object of the present invention to provide a printing apparatus and a check pattern printing method which requires not so long time for a registration adjustment even upon performing high precision printing, and does not cause increasing of the running cost for performing the registration adjustment.

Another object of the present invention is to provide a printing apparatus and a check pattern printing method, in which a first check pattern is printed at first, for example, a registration adjustment is performed between a plurality of heads on a basis of the first check pattern, and a second check pattern is printed on a basis of a result of the registration adjustment, wherein, for example, the first check pattern is printed at low resolution and the second check pattern of high resolution is printed under a condition where the registration adjustment is performed based on the first check pattern so that printing of the second check pattern can be performed in a condition where registration is adjusted in a certain extent, and can be performed with high precision.

A further object of the present invention is to provide a printing apparatus and a check pattern printing method which can save a printing medium for check pattern printing, by printing a plurality of check patterns on a single printing medium.

In a first aspect of the present invention, there is provided a printing apparatus performing printing on a printing medium by using a printing head, comprising:

pattern printing means for printing a check pattern used for inspecting a mutual positional relationship between images to be printed at different timings;

setting means for setting printing timing of the printing head based on inputting of set information concerning the mutual positional relationship between the images; and control means for making the pattern printing means print a first check pattern, making the setting means set printing timing of the printing head based on set information input on a basis of the first check pattern, and making the pattern printing means print a second check pattern under a condition that the printing timing is set by the setting means.

In a second aspect of the present invention, there is provided a printing apparatus performing printing on a printing medium by using a printing head, comprising:

executing means for executing a plurality of printing modes which differ from each other in a resolution of printing, and control means for, for each of the plurality of printing modes, executing pattern printing for printing a check pattern for inspecting mutual positional relationships of images to be printed at different timings and executing timing setting for setting a printing timing of the printing head in the printing mode based on an input of set information concerning the mutual positional relationship between the images the execution of the pattern printing and the timing setting for each of the plurality of printing modes being performed sequentially from the printing mode of the lower resolution to the printing mode of the higher resolution, wherein the pattern printing of the check pattern in each printing mode is performed at the printing timing set based on the check pattern printed in preceding printing mode.

In a third aspect of the present invention, there is provided a printing apparatus performing printing on a printing medium by using a printing head, comprising:

transporting means for relatively transporting the printing medium with respect to the printing head; and pattern printing means for printing a check pattern which is printed first among a plurality of check patterns on a central portion of the printing medium when the plurality of check patterns are printed in sequential order on the same printing medium by controlling the transporting means, and for printing the plurality of check patterns without causing interference with each other.

In a fourth aspect of the present invention, there is provided a check pattern printing method of a printing apparatus performing printing on a printing medium by using a printing head, comprising the steps of:

printing a first check pattern for inspecting a mutual positional relationship between images printed at different timings;

setting printing timing of the printing head based on the first check pattern; and printing a second check pattern for inspecting the mutual positional relationship between the images under a condition that the printing timing is set.

In a fifth aspect of the present invention, there is provided a check pattern printing method of a printing apparatus performing printing on a printing medium by using a printing head, comprising the steps of:

printing a check pattern which is printed first among a plurality of check patterns on a central portion of the printing medium when the plurality of check patterns are printed in sequential order on the same printing medium, and printing the plurality of check patterns without causing interference with each other.

In a sixth aspect of the present invention, there is provided a registration adjusting method of a printing apparatus performing printing on a printing medium by using a printing head, comprising the steps of:

printing a first check pattern for inspecting a mutual positional relationship between images printed at different timing;

setting printing timing of the printing head based on the first check pattern;

printing a second check pattern for inspecting the mutual positional relationship between the images under a condition that the printing timing is set; and setting the printing timing of the printing head based on the second check pattern.

The above and other objects, effects, features and advantages of the present invention will become more apparent from the following description of embodiments thereof taken in conjunction with the accompanying drawings.

DESCRIPTION OF PREFERRED EMBODIMENTS

The preferred embodiments of the present invention will be explained hereinafter with reference to the accompanying drawings.

Figure 1:
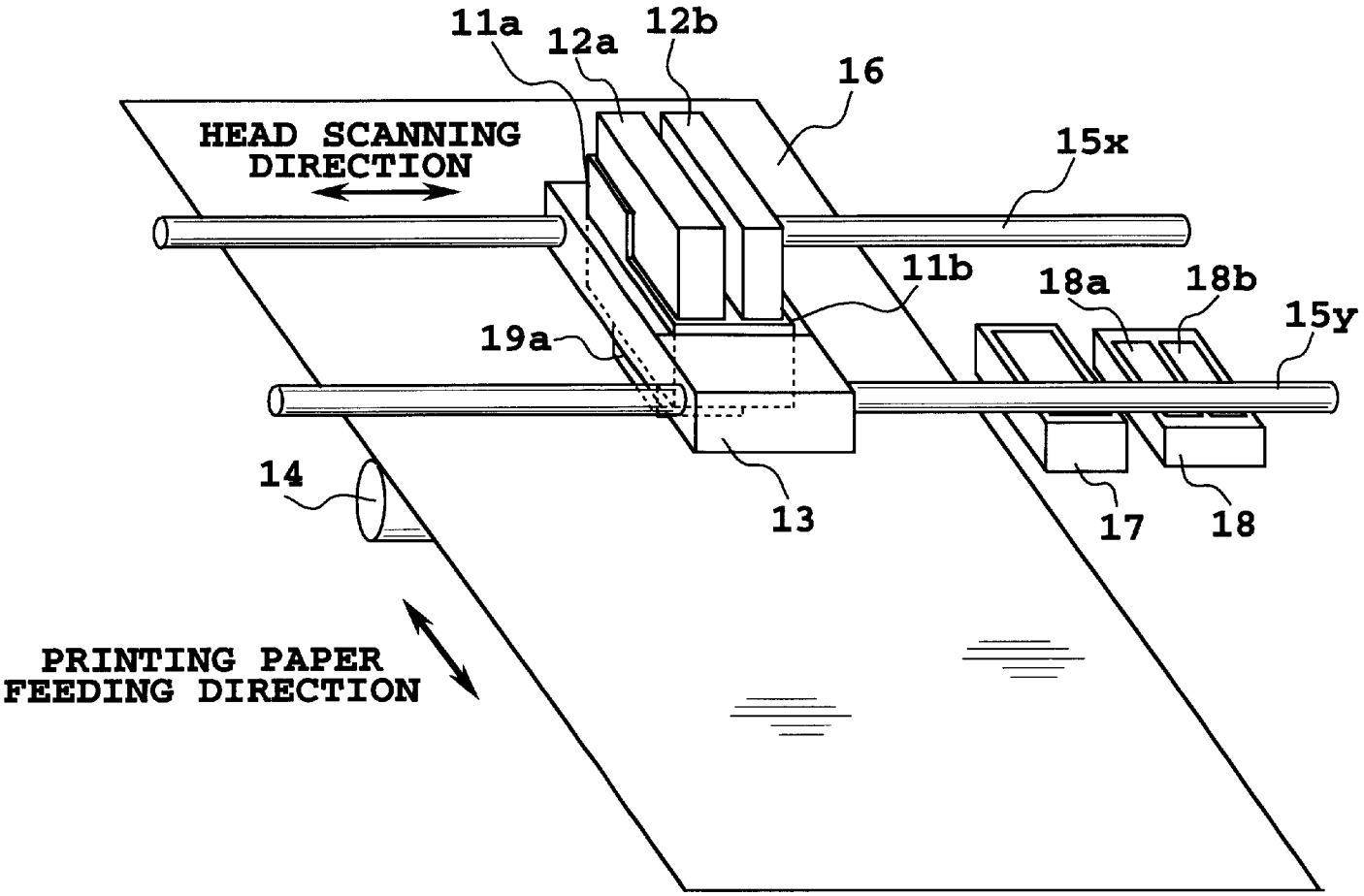
FIG. 1 is a perspective view schematically showing a major construction of one embodiment of an ink-jet printing apparatus according to the present invention.

FIG. 1 is a perspective view schematically showing a construction of a printing portion in one embodiment of an ink-jet printing apparatus according to the present invention.

In FIG. 1, reference numerals 11*a* and 11*b* denote head cartridges respectively having printing head portions 19*a* and 19*b* and detachably mounting tanks 12*a* and 12*b* corresponding to these head portions, respectively. A reference numeral 13 denotes a carriage detachably mounting the head cartridges 11*a* and 11*b* and moving along guide shafts 15*x* and 15*y* to scan the printing heads 19*a* and 19*b*in a scanning direction (primary scanning direction). In respective of the tanks 12*a* and 12*b*, an ink and a processing liquid which makes the ink insoluble are stored in respectively separated chambers.

Figure 2A:
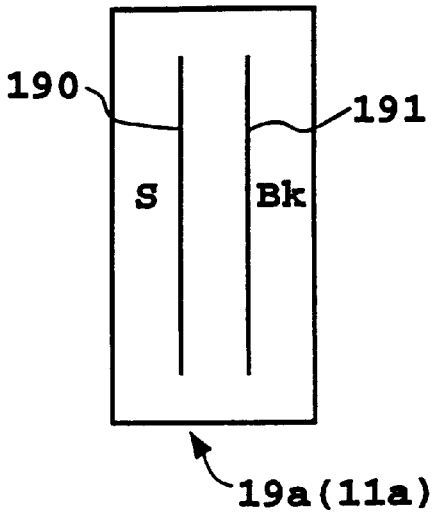
FIGS. 2A and 2B are schematic illustrations showing an ejection opening array of a printing head to be used in the foregoing apparatus.
Figure 2B:
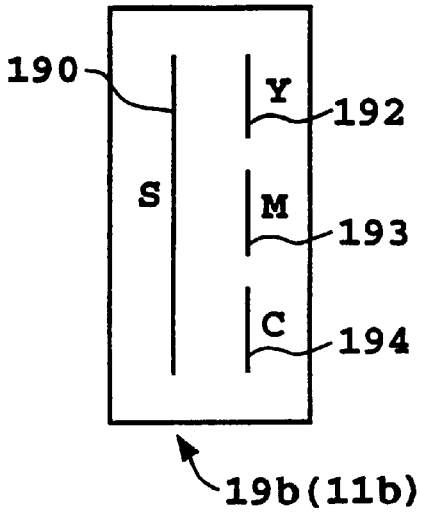

Respective printing head portions 19*a* and 19*b* as viewed from ejection opening surface side are diagrammatically illustrated in FIGS. 2A and 2B. In these drawings, lines identified by reference numerals 190 to 194 represent ejection opening arrays for ejecting the processing liquid and the ink, respectively.

As shown in FIGS. 2A and 2B, the ink jet printing apparatus of the shown embodiment employs two printing head portions (head cartridges). The printing head portions shown in FIGS. 2A and 2B ejects the processing liquid (S) which reacts with the ink to make a dye in the ink insoluble or coagulated, from respective ejection openings of the ejection opening array 190. Further, from respective ejection openings of the ejection opening array 191 as shown in FIG. 2A, a black (Bk) ink is ejected. On the other hand, from ejection opening arrays 192, 193 and 194 of the printing head portion shown in FIG. 2B, color inks of respective yellow (Y), magenta (M) and cyan (C) are ejected. It should be noted that in the ejection opening array of the processing liquid and the black ink, 304 ejection openings are arranged in a density of 600 dpi, and the respectively 80 ejection openings are arranged in ejection opening arrays of yellow, magenta and cyan in a density of 600 dpi. By selectively using two printing head portions 19*a* and 19*b*, an image can be printed appropriately adapted to both of a document text and color graphics.

It should be noted that, while the heads and other components are constructed as set forth above in the shown embodiment, the construction of the carriage, head or so forth is not specified. For instance, the carriage mounting two or more head cartridges may be used, and a head cartridge for each color of ink having only one ejection array may be used. Further, the head cartridge having a plurality of ejection opening arrays may also be used.

Referring again to FIG. 1, a reference numeral 16 is a printing medium and a reference numeral 14 denotes a transporting roller for transporting the printing medium in a paper feeding direction (subsidiary scanning direction).

In the construction stated above, by alternately performing scanning of the head portion, in which the processing liquid or the ink is ejected from respective ejection openings of the ejection opening array while moving the printing head portion in the scanning direction, and transporting of the printing medium, printing can be performed on an entire area of the printing medium.

A reference numeral 18 denotes a cap which is formed with an elastic material such as rubber or the like, faces an ejection opening forming surface of the printing head portion at a home position, and is supported to move on contacting and releasing with respect to the printing head portion. The cap 18 is used for protecting the printing head portion while not in a printing operation, and for performing forced suction process by means of a suction pump (not shown) in order to remove the processing liquid or the ink deposited on the ejection opening forming surface, to remove a bubble in the ejection opening or a liquid passage communicating with the ejection opening. In the shown embodiment, since the head portion ejecting the processing liquid and the ink is used, the cap 18 includes cap portions 18*a* and 18*b* for respectively performing suction recovery and so on for the processing liquid and the ink. This is because that mixing of the processing liquid and the ink instantly causes deposition of a reacted product which is difficult to be removed.

A reference numeral 17 denotes an ink receptacle used for an ejection recovery operation by a preliminary ejection operation. The preliminary ejection operation means a process to eject the ink from respective ejection openings of respective printing head portions 19*a* and 19*b* for forcedly discharging bubble, dust, the ink of increased viscosity to be inappropriate for printing and the like, together with the ejected ink.

The ink to be used in the shown embodiment contains a water soluble dye having an anionic radical, water, a water soluble organic solvent and other components, such as a viscosity adjusting agent, a pH adjusting agent, an antiseptic agent, a surface active agent, and antioxidation as required.

Further, the processing liquid contains a water soluble polymer having a cationic radical, water, a water soluble organic solvent and other components, such as a viscosity adjusting agent, a pH adjusting agent, an antiseptic agent, a surface active agent, and antioxidation as required.

It should be appreciated that while an anionic substance is contained in the ink and the cationic substance is contained in the processing liquid in the shown embodiment, ionicity of the ink and the processing liquid is not particularly specified.

One example of compositions of the ink and the processing liquid useful in the shown embodiment are as follows:

| Ink | |
|---|---|
| BK: | |
| C.I. food black -2; | 3 parts by weight |
| glycerin | 15 parts by weight |
| water | 82 parts by weight |
| **Processing Liquid** | |
| polyallyl amine | 4 parts by weight |
| glycerin | 15 parts by weight |
| water | 81 parts by weight |

The ink-jet printing apparatus of the shown embodiment constructed as set forth above is capable of performing printing in two kinds of modes. More specifically, the ink-jet printing apparatus of the shown embodiment has two kinds of printing modes, i.e. a low resolution printing mode, in which printing is performed at relatively low resolution of 600 dpi×600 dpi and a high resolution printing mode, in which printing is performed at relatively high resolution of 1200 dpi×600 dpi, with respect to the primary scanning direction and the subsidiary scanning direction, respectively. In the low resolution mode, printing is performed at a higher carriage speed.

First Embodiment

Next, a first embodiment of a check pattern printing for registration adjustment in the apparatus constructed as set forth above, will be described.

The registration adjustment of mutual positions of dots formed in the primary scanning direction by means of the printing head portions 19*a* and 19*b* is performed by adjusting the ejection timing of respecting head portions. In the shown embodiment, the check pattern is formed by ejecting ink from the ejection opening array 191 for the Bk ink of the printing head portion 19*a* and from the ejection opening array 193 for the M ink of the printing head portion 19*b*.

Figure 3:
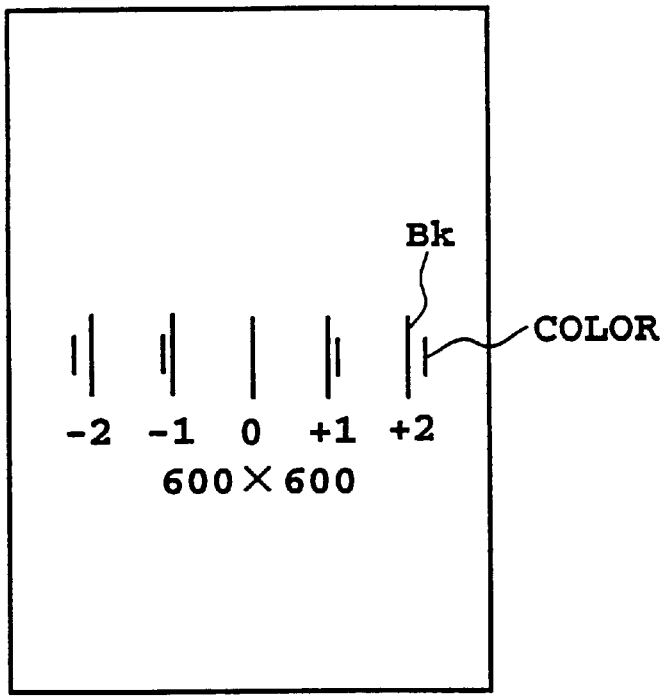
FIG. 3 is an illustration for explaining printing of a first check pattern for a registration adjustment in the first embodiment of the present invention.

At first, as a first check pattern, a check pattern is printed in the low resolution printing mode, as shown in FIG. 3. This pattern is printed at substantially central portion in the transporting direction on the printing medium.

More specifically, by scanning the printing head portions 19*a* and 19*b* for the central portion of the printing medium, for Bk ink, ejection is performed through all of ejection openings of the ejection opening array 191 at a predetermined time interval. On the other hand, for M ink, in relation to respective ejection timing of the Bk ink determined on a basis of the predetermined time interval, ejection is performed through all ejection openings of the ejection opening array 193 at timing of "0" position contemporarily set at the time when printing of the check pattern is performed, namely, at timing which is regarded as timing where the M ink overlays with the Bk ink with respect to ejection positions, and a timing corresponding to a position "−2", "−1", "+1" and "+2", which are regarded as timing where deviations corresponding to two or one dot pitches are caused toward left or right with respect to the ejection position of the Bk ink. It should be noted that the deviation corresponding to one dot pitch corresponds to a distance of about 40 $\mu$m in case of a printing resolution of 600 dpi.

In the example shown in FIG. 3, it has been observed that the dot of the Bk ink and the dot of the M ink are overlaid with each other at the timing of position "0". The timing at this position is set by inputting through an operation key provided in a host system or the ink-jet printing apparatus of the shown embodiment.

Figure 4:
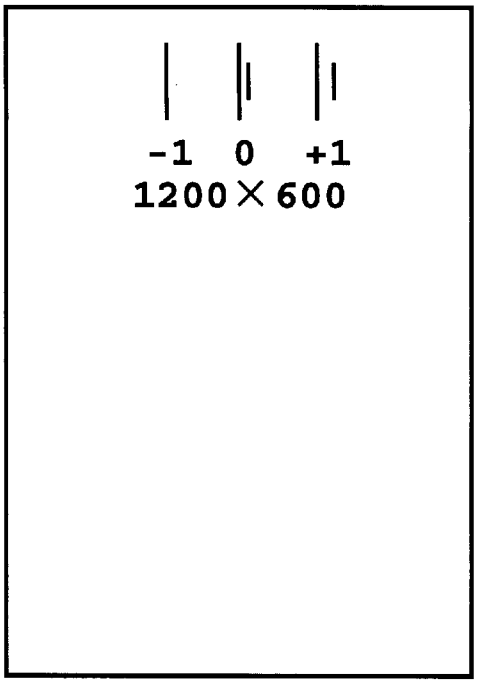
FIG. 4 is an illustration for explaining printing of a second check pattern to be printed after printing the first check pattern.

Next, as a second check pattern, a check pattern is printed on the printing medium on which the first check pattern has been already printed in the high resolution mode, as shown in FIG. 4. At this time, in order to avoid interference of the second check pattern with the first check pattern, the second check pattern is printed at an upper portion of the first check pattern concerning the transporting direction of the printing medium.

In this case, the check pattern is printed similarly to the first check pattern, with differentiating the respective ejection timing of the M ink with respect to the respective ejection timing of the Bk ink which has predetermined time intervals. The timing corresponding to position "0" is set as timing set on a basis of a result of observation of the foregoing first check pattern, that is, timing corresponding to position "0", in the example shown in FIG. 3. Then, printing is also performed at a timing corresponding to positions "−1" or "+1" shifted for one dot pitch (corresponding to 20 m) toward left or right.

Figure 5:
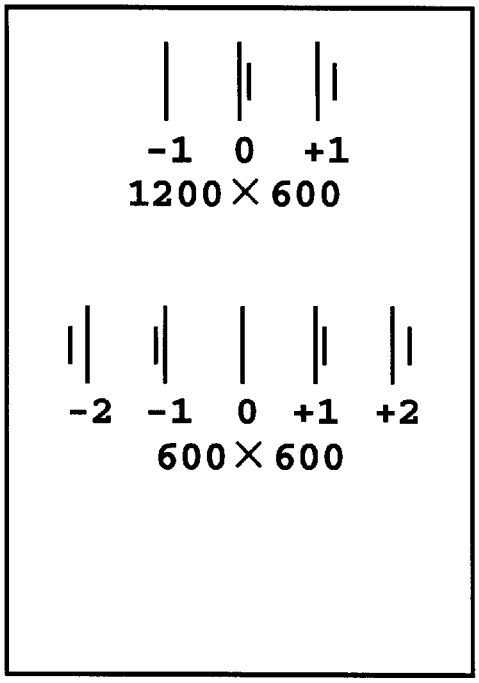
FIG. 5 is an illustration showing a condition where the first and the second check patterns are printed in one printing medium.

Results of printing of the first and second check patterns are shown in FIG. 5. In a result of printing of the second check pattern, in the example shown in FIG. 4 (FIG. 5), for example, the ejecting positions of the Bk ink and the M ink are matched at the timing of position "−1". Thus, the timing corresponding to this position is set as the new ejection timing of the M ink relative to the ejection timing of the Bk ink. It should be noted that the first and the second check patterns are printed so that the first and the second patterns of predetermined respective lengths in the subsidiary scanning direction are elongated by performing a plurality of scannings and a plurality of corresponding transportations of the printing medium.

In addition, control of the check pattern printing and setting of the timing data on the basis of the check pattern, set forth above, can be executed by a control system of the construction constituted of a CPU and a memory, such as RAM, ROM or the like, as will be explained with reference to FIG. 8.

Figure 7:
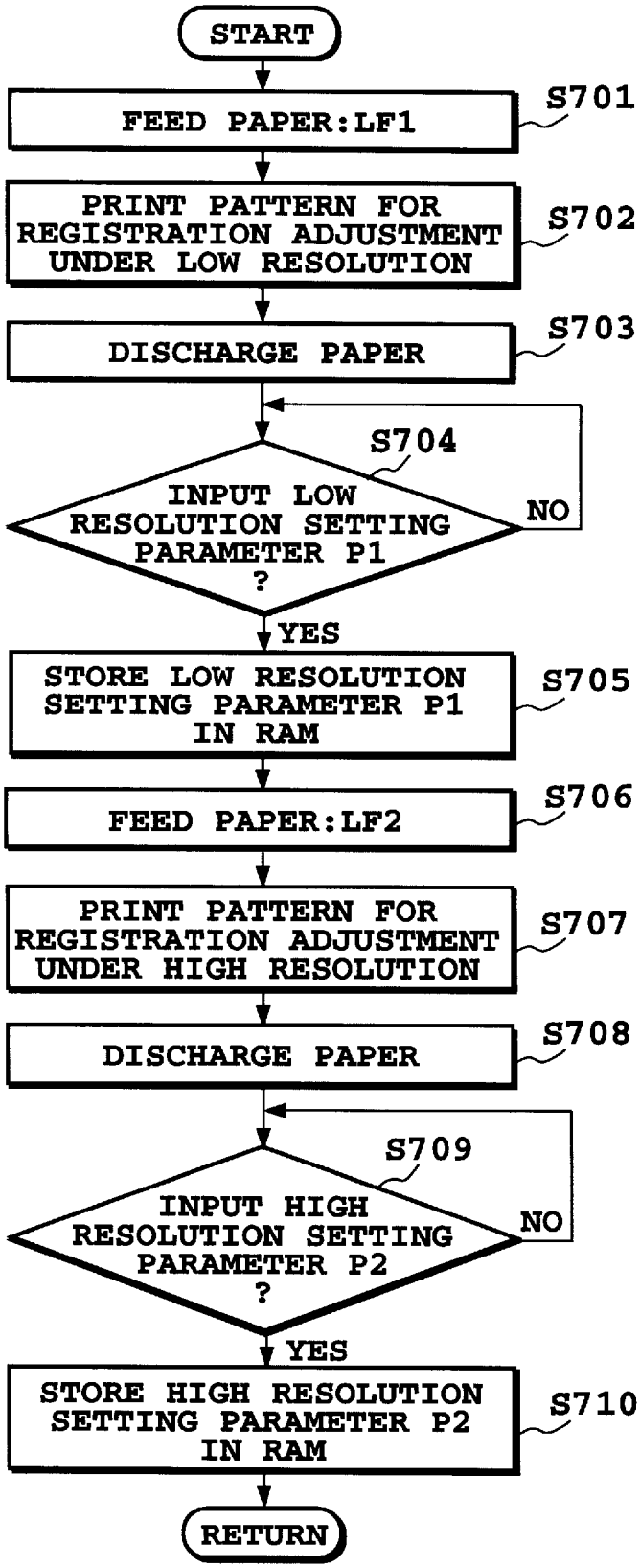
FIG. 7 is a flowchart showing a process procedure concerning printing of the first and second check patterns in the first embodiment.

FIG. 7 is a flowchart showing a processing procedure concerning printing of the first and the second check patterns.

When the printing medium is set at a paper feeding position and a predetermined check pattern printing command input is given, the shown processing is triggered. At step S701, a paper feeding operation of a paper feeding amount LF1 is performed, and whereby, a scanning region of the printing head portions can correspond to a substantially central portion of the printing medium, as described above. Next, at step S702, with performing a plurality of scanning operations and performing corresponding transportation of the printing medium for a predetermined amount in the substantially central portion of the printing medium, printing of the low resolution registration adjusting pattern (the first check pattern) as the check pattern at the low resolution printing mode is performed. Subsequently, the printing medium is discharged by a paper discharging operation at step S703.

Here, a user observes the check pattern on the printing medium as set forth above to input a timing setting value in the low resolution printing mode. At step S704, inputting of the setting value is waited. When the setting value is inputted, a low resolution setting parameter P1 (a parameter corresponding to any one of the positions "0", "−2", "−1", "+1" and "+2" shown in FIG. 3, is stored in RAM. The stored parameter P1 is used for printing at step S707 which will be described later and for low resolution printing using the Bk printing head 19*a* and the color printing head 19*b*.

When inputting of the parameter P1 is completed, at step S706, setting of the printing medium in the paper feeding position by the user is waited. When setting of the printing medium in the paper feeding position is detected, paper feeding in a feeding amount LF2 is performed. By this, a position to print the second check pattern of high resolution on the printing medium, can be set at upper portion of the printing medium positioned away from the central portion thereof. Then, at step S707, with performing a plurality of scanning operations and performing corresponding transportation of the printing medium for a predetermined amount at the upper position of the printing medium, printing of the high resolution registration adjusting pattern (the second check pattern) as the check pattern at the high resolution printing mode is performed, and then discharge of the printing medium is performed at step S708.

Next, at step S709, inputting of a high resolution setting parameter P2 (a parameter corresponding to any one of "0", "−1" and "+1" positions shown in FIG. 4) by the user is waited similarly to step S704. When the high resolution setting parameter P2 is input, a corresponding value is stored in RAM. This value is used in high resolution printing using the BK printing head portion 19*a* and the color printing head 19*b*.

As set forth above, by the foregoing sequence of process, the parameter for adjusting registration at respective resolution can be set. In conjunction therewith, in advance of the process for adjustment of registration for high resolution, adjustment of registration for lower resolution is performed.

By the shown embodiment of check pattern printing as set froth above, printing of the first check pattern is performed under low resolution to perform registration adjustment based on the result thereof. Subsequently, printing of the second check pattern is performed under the high resolution condition. Therefore, deviation of dots caused in printing of the second check pattern can be restricted in the extent of one dot pitch in substantially 1200 dpi. Thus, the registration adjustment under the high resolution condition can be done easily and in a short period. Also, since the deviation is less than or equal to one dot pitch, it would be sufficient to print the second check pattern at respective positions of "−1", "0" and "+1". Thus, check pattern printing per se can be done in a short period.

In addition, when relatively expensive printing medium is used for printing the check pattern, since two check patterns are printed on one printing medium, cost for the registration adjustment can be restricted to contribute lowering of running cost.

Furthermore, the second check pattern is printed on the printing medium on which the first check pattern is printed. At this time, even if the user erroneously insert the printing medium in the reversed direction, since the first check pattern is printed at the substantially central portion, the first check pattern may not cause interference with the second check pattern.

It should be noted that, in the foregoing process shown in FIG. 7, detail of the line feeding amount LF1 as a feeding amount for printing the check pattern in the low resolution printing mode is as follows. The amount is a total of a feeding amount of the printing medium fed from the paper feeding position to reach a position in which an end portion of the printing medium faces the printing head portion, and a feeding amount corresponding to ⅓ of the printing medium of an assumed A4 size from the end portion of the printing medium. Here, with taking a resolution of 600 dpi as a unit of feeding, the feeding amount is 2200 units. Also, the feeding amount LF2 for printing the check pattern in the high resolution printing mode is set to be 100 units from the end portion of the printing medium of the assumed A4 size, similarly to the case of the amount LF1.

Furthermore, a size of a printing region for performing printing of the check pattern in the low resolution printing mode with paper feeding for a predetermined amount in the central portion is set to be less than or equal to 2000 units as about ⅓ of the feeding amount of the printing medium of A4 size in the feeding direction. Also, in order to print the check pattern in the high resolution printing mode without causing interference with the already printed check pattern in the low resolution (without causing overlapping in the shown embodiment), the size of the printing region of the check pattern in the high resolution printing mode is set to be less than or equal to 2000 units as about the feeding amount of ⅓ of the printing medium of A4 size in the feeding direction.

Second Embodiment

The shown embodiment is adapted for printing a check pattern for the registration adjustment and a check pattern for checking whether ejection is normally performed or not, on one printing medium. By this, similarly to the former embodiment, lowering of running cost can be achieved.

Figure 6:
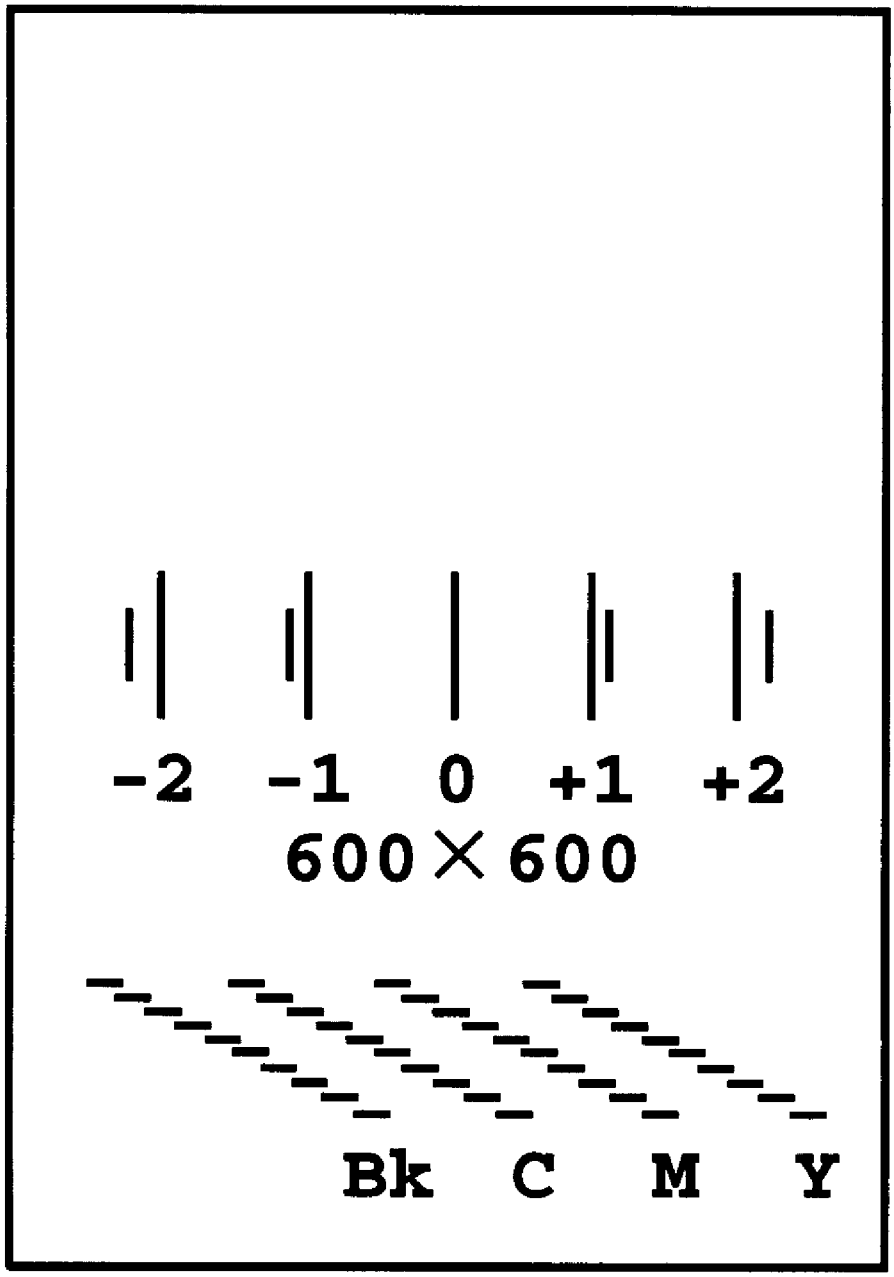
FIG. 6 is an illustration showing check patterns of a second embodiment of the present invention.

FIG. 6 is a diagrammatic illustration showing an example of printing of these check patterns. As shown in FIG. 6, the check pattern for the registration adjustment is printed at a substantially central portion of the printing medium. On the lower portion of the printing region where the check pattern for the registration adjustment is printed, is the check pattern for checking normal ejection, in which printing positions are shifted per ejection openings for respective colors.

It should be noted that, in the shown embodiment of the ink-jet printing apparatus according to the present invention, since the processing liquid which makes the ink insoluble is used, bleeding of the ink in the check pattern may be restricted by additionally performing ejection of the processing liquid upon check pattern printing for achieving further higher precision in the registration adjustment.

Figure 8:
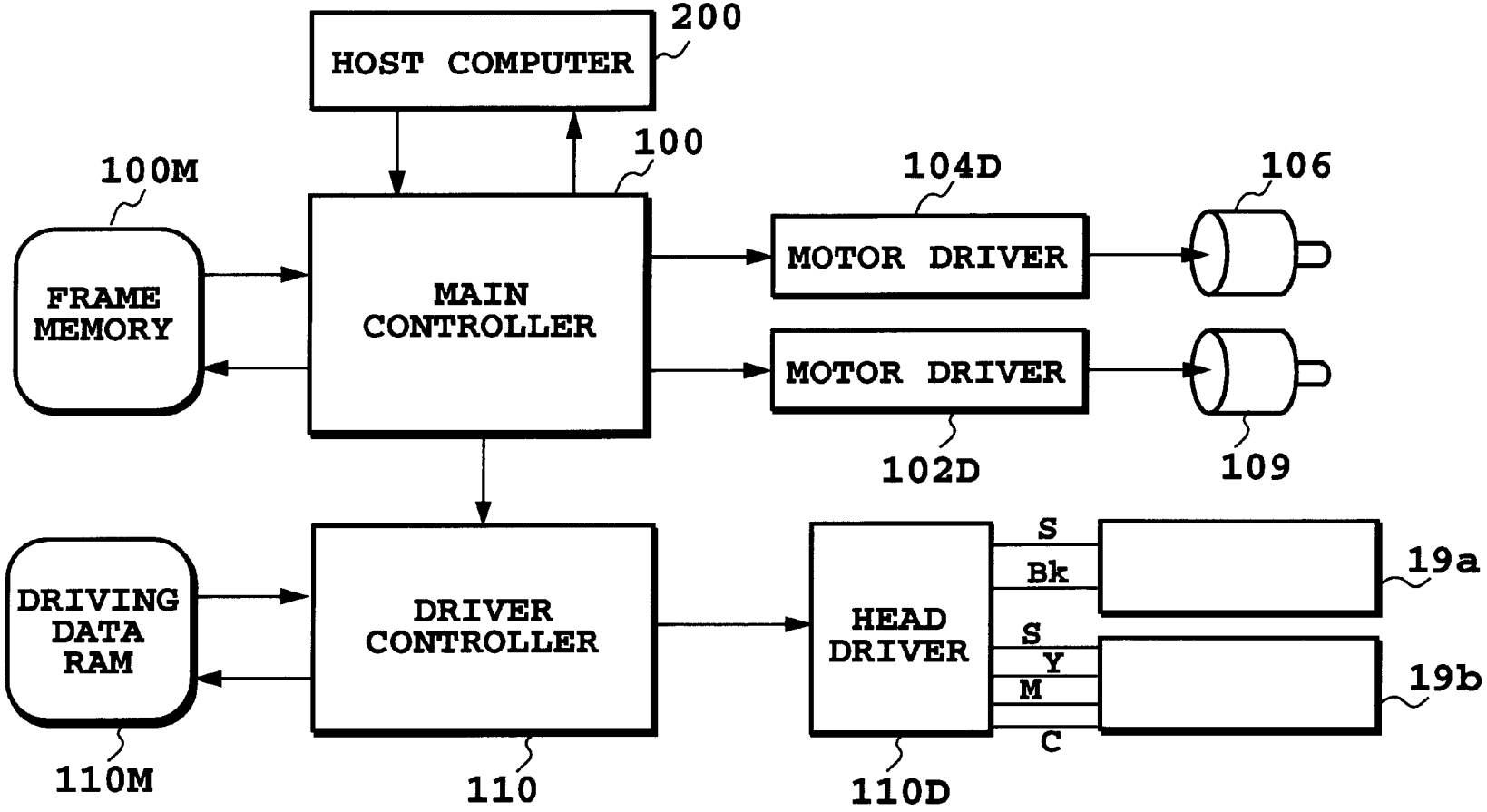
FIG. 8 is a block diagram showing a construction of a control system in the ink-jet printing apparatus shown in FIG. 1.

FIG. 8 is a block diagram showing a construction of a control system of the ink-jet printing apparatus shown in FIG. 1.

A main controller 100 is constituted of CPU, ROM for storing the processing procedure shown in FIG. 7 and so on, RAM to be used as a work area for process to be executed by CPU, and so on. The main controller 100 converts an image data fed from a host computer 200 into pixel data respectively provided with gradation data to store the converted pixel data in a frame memory 100M. Also, the main controller 100 supplies the gradation data of respective pixels stored in the frame memory 100M to a driver controller 110. The driver controller 110 converts the supplied gradation data into ejection data (data for turning ON and OFF heaters in respective head) corresponding to ejection opening numbers (indicative of an order in a sequence of each ejection opening in the ejection opening arrays in respective printing heads 19*a* and 19*b*) and a scanning number (order in a sequence of primary scans) to store in a driving data RAM 110M. The driver controller 110 is responsive to a control signal from the main controller 100 to read out the driving data stored in the driving data RAM 110M with reference to the ejection opening number and the scanning number to supply to a head driver 110D, and in conjunction therewith, to control driving timing thereof.

In the foregoing construction, the main controller 100 controls ejection of respective colors of inks and the processing liquid, revolution of a carriage motor 106 and revolution of a paper feeder motor 109 via the driver controller 110, a motor driver 104D and a motor driver 102D, respectively. By this, characters and graphics images and the like depending upon the image data can be printed on the printing paper 10.

Other Embodiments

While explanation has been given for the case where two check patterns are printed in the foregoing embodiments, it may be possible to use three or more check patterns seeking for further higher precision in the registration adjustment. Even in this case, it is preferred to control the printing position of respective check patterns so that respective check patterns may be printed on a single printing medium. Also, even in the case where three or more printing modes having mutually different resolution are present, it may be possible to perform printing of the check patterns in respective printing modes and to set dot printing timings for respective printing modes. Furthermore, also in this case, the registration adjustment required lower accuracy is performed more precedingly and the set value set at the preceding registration adjustment is used for the following registration adjustment. As a result of this, the subsequent registration adjustment can be sequentially performed with ease.

In addition, application of the present invention is not limited to correction of the deviation of dots due to position error between a plurality of printing heads as in the foregoing embodiment. For instance, the present invention is applicable for the case where reciprocal printing is to be performed using one printing head and for correcting error in overlaying of the dots to be printed or error in positional relationship with respect to each other.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from a solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As can be clear from the foregoing description, by the preferred embodiments of the present invention, the first check pattern is at first printed to perform the registration adjustment between a plurality of heads on the basis of the result thereof, and on the basis of the result of adjustment, to perform printing of the second check pattern. Therefore, the first check pattern is printed in low resolution, and the second check pattern is printed under the condition where the registration adjustment is made based on the result of printing of the first check pattern. By this, the second check pattern can be printed with high precision under the condition where the registration adjustment is made to facilitate subsequent the registration adjustment.

In addition, the plurality of check patterns can be printed on the same printing medium to save the printing medium for printing the check pattern.

As a result, the registration adjustment can be facilitated and performed in a short period. Also, the running cost of the apparatus can be lowered.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus performing printing on a printing medium by using a printing head, comprising:

pattern printing means for printing a check pattern used for inspecting a mutual positional relationship between images to be printed at different timings;

setting a means for setting printing timing of the printing head based on inputting of set information concerning the mutual positional relationship between the images; and control means for making said pattern printing means print a first check pattern, making said setting means set the printing timing of the printing head based on set information input on a basis of the first check pattern, and making said pattern printing means print a second check pattern under a condition that said printing timing is set by said setting means.

2. A printing apparatus as claimed in claim 1, which comprises a plurality of printing heads and wherein a printing image is formed by images printed by said plurality of printing heads at respectively different timings.

3. A printing apparatus as claimed in claim 2, wherein said pattern printing means prints the first check pattern in a predetermined resolution and prints the second check pattern in a resolution higher than said predetermined resolution.

4. A printing apparatus as claimed in claim 3, which further comprises transporting means for relatively transporting the printing medium with respect to the printing head, and wherein said control means controls said transporting means so that when said pattern printing means prints the second check pattern on the printing medium on which the first check pattern has been already printed, said second check pattern does not interfere with said first check pattern.

5. A printing apparatus as claimed in claim 4, wherein said control means controls said transporting means so that when said pattern printing means prints the first check pattern, said first check pattern is printed at a central portion of the printing medium.

6. A printing apparatus as claimed in claim 1, wherein the printing head ejects an ink toward the printing medium in order to perform printing.

7. A printing apparatus as claimed in claim 6, further comprising means for supplying a processing liquid making the ink ejected by the printing head insoluble.

8. A printing apparatus as claimed in claim 6, wherein the printing head includes a thermal energy generating element for generating thermal energy used for ejecting the ink.

9. A printing apparatus performing printing on a printing medium by using a printing head, comprising:

executing means for executing a plurality of printing modes which differ from each other in a resolution of printing, and control means for, for each of the plurality of printing modes, executing pattern printing for printing a check pattern for inspecting mutual positional relationship of images to be printed at different timings and executing timing setting for setting a printing timing of the printing head in the printing mode based on an input of set information concerning the mutual positional relationship between the images said execution of the pattern printing and the timing setting for each of the plurality of printing modes being performed sequentially from the printing mode of the lower resolution to the printing mode of the higher resolution, wherein the pattern printing of the check pattern in each printing mode is performed at the printing timing set based on the check pattern printed in a preceding printing mode.

10. A printing apparatus as claimed in claim 9, further comprising a plurality of printing heads, and wherein a printing image is formed by images printed by said plurality of printing heads at respectively different timings.

11. A printing apparatus as claimed in claim 10, further comprising transporting means for relatively transporting the printing medium with respect to the printing head, and wherein said control means controls said transporting means so that when a plurality of check patterns are sequentially printed on the printing medium, said plurality of check patterns do not interfere with each other.

12. A printing apparatus as claimed in claim 11, wherein said control means prints a first check pattern on a central portion of the printing medium when the first check pattern among a plurality of check patterns is printed.

13. A printing apparatus as claimed in claim 9, wherein the printing head ejects an ink toward the printing medium in order to perform printing.

14. A printing apparatus as claimed in claim 13, further comprising means for supplying a processing liquid making the ink ejected by the printing head insoluble.

15. A printing apparatus as claimed in claim 13, wherein the printing head includes a thermal energy generating element for generating thermal energy used for ejecting the ink.

16. A printing apparatus performing printing on a printing medium by using a printing head, comprising:

transporting means for relatively transporting the printing medium with respect to the printing head; and pattern printing means for printing a check pattern which is printed first among a plurality of check patterns on a central portion of the printing medium when the plurality of check patterns are printed in sequential order on the same printing medium by controlling said transporting means, and for printing the plurality of check patterns without causing interference with each other.

17. A check pattern printing method of a printing apparatus performing printing on a printing medium by using a printing head, comprising the steps of:

printing a first check pattern for inspecting a mutual positional relationship between images printed at different timings;

setting a printing timing of the printing head based on the first check pattern; and printing a second check pattern for inspecting the mutual positional relationship between the images under a condition that said printing timing is set.

18. A check pattern printing method of a printing apparatus performing printing on a printing medium by using a printing head, comprising the steps of:

printing a check pattern which is printed first among a plurality of check patterns on a central portion of the printing medium when the plurality of check patterns are printed in sequential order on the same printing medium, and printing the plurality of check patterns without causing interference with each other.

19. A registration adjusting method of a printing apparatus performing printing on a printing medium by using a printing head, comprising the steps of:

printing a first check pattern for inspecting a mutual positional relationship between images printed at different timings;

setting a printing timing of the printing head based on the first check pattern;

printing a second check pattern for inspecting the mutual positional relationship between the images under a condition that said printing timing is set; and setting a printing timing of the printing head based on the second check pattern.

* * * * *

UNITED STATES PATENT AND TRADEMARK OFFICE

CERTIFICATE OF CORRECTION

PATENT NO. : 6,084,606

DATED : July 4, 2000

INVENTOR(S) : MORIYAMA

It is certified that error appears in the above-identified patent and that said Letters Patent is hereby corrected as shown below:

COLUMN 1:
Line 4, "Ser." should be deleted.

COLUMN 4:
Line 32, "respective" should read --respective ones--.
Line 56, "the respectively" should read --respective--.
Line 60, "of a" should be deleted.

COLUMN 6:
Line 34, "respecting" should read --respective--.

COLUMN 7:
Line 61, "waited." should read --awaited.--.

COLUMN 8:
Line 51, "insert" should read --inserts--.

COLUMN 10:
Line 18, "required" should read --requiring-- and "more" should be deleted.

UNITED STATES PATENT AND TRADEMARK OFFICE

CERTIFICATE OF CORRECTION

PATENT NO. : 6,084,606

DATED : July 4, 2000

INVENTOR(S) : MORIYAMA

It is certified that error appears in the above-identified patent and that said Letters Patent is hereby corrected as shown below:

COLUMN 12:

Line 28, "the" should be deleted.

Line 49, "setting a means for setting" should read --setting means for setting a--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*